US007497272B2

(12) United States Patent
Strasser et al.

(10) Patent No.: US 7,497,272 B2
(45) Date of Patent: Mar. 3, 2009

(54) HAND-HELD POWER TOOL

(75) Inventors: Andreas Strasser, Rudersberg (DE); Markus Leupert, Murrhardt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/556,477

(22) PCT Filed: Feb. 2, 2005

(86) PCT No.: PCT/EP2005/050440

§ 371 (c)(1),
(2), (4) Date: Nov. 14, 2005

(87) PCT Pub. No.: WO2005/087446

PCT Pub. Date: Sep. 22, 2005

(65) Prior Publication Data

US 2007/0074883 A1 Apr. 5, 2007

(30) Foreign Application Priority Data

Mar. 13, 2004 (DE) ..... 10 2004 012 433

(51) Int. Cl.
*E02D 7/02* (2006.01)

(52) U.S. Cl. ..... 173/48; 173/4; 173/47

(58) Field of Classification Search ..... 173/4, 173/47, 48, 162.2, 104, 2
See application file for complete search history.

(56) References Cited

U.S. PATENT DOCUMENTS 4,236,588 A * 12/1980 Moldan et al. ..... 173/48
4,284,148 A 8/1981 Wanner et al.
4,401,958 A 8/1983 Noorigian
4,442,906 A * 4/1984 Simpson ..... 173/48
4,689,534 A 8/1987 Gerber et al.
4,979,497 A * 12/1990 Matsuura et al. ..... 600/131
5,111,890 A 5/1992 Ranger et al.
6,550,545 B1 4/2003 Manschitz et al.
6,766,868 B2 7/2004 Frauhammer et al.
6,976,545 B2 * 12/2005 Greitmann ..... 173/104
2001/0052416 A1 12/2001 Wissmach et al.
2003/0037937 A1 2/2003 Frauhammer
2003/0121678 A1 * 7/2003 Manschitz et al. ..... 173/48
2003/0196824 A1 * 10/2003 Gass et al. ..... 173/131

FOREIGN PATENT DOCUMENTS

DE 28 20 128 11/1979
DE 29 26 111 1/1981
DE 38 26 213 A1 2/1990

(Continued)

*Primary Examiner*—Rinaldi I. Rada
*Assistant Examiner*—Nathaniel Chukwurah
(74) *Attorney, Agent, or Firm*—Michael J. Striker

(57) ABSTRACT

A hand-held power tool, in particular a rotary hammer, is indicated that includes a machine housing (10) with a tool fitting (12) integrated therein, the tool fitting (12) being rotatably drivable in a first mode and being non-rotatably fixable on the machine housing (10) in a second mode, and that includes a duty-type switch (20) with a coupling element (21) capable of being displaced to activate the modes, and an actuating element (22) that induces its displacement. To prevent maloperation and resultant damage to the machine when the operator switches between modes, the actuating element is designed as an electrical actuator (23), preferably as an electromagnet (25) controlled by an electronic control unit (24) (FIG. 1).

13 Claims, 1 Drawing Sheet

FOREIGN PATENT DOCUMENTS

| | | | |
|---|---|---|---|
| DE | 92 02 475 | | 6/1992 |
| DE | 43 43 583 | A1 | 6/1995 |
| DE | 100 29 133 | A1 | 1/2002 |
| DE | 197 20 947 | B4 | 7/2005 |
| EP | 0 771 619 | A3 | 5/1997 |
| EP | 0 884 138 | A3 | 11/2002 |
| GB | 2 285 007 | | 6/1995 |
| GB | 2 314 288 | A | 12/1997 |
| WO | 02/06015 | A1 | 1/2002 |

* cited by examiner 11
38
39
36
40
34
33
371
37
372
24
10
25
35
23
22
15
20
21
32
26
28
29
291
42
41
12
13
43
46
45
451
44
17
16
18
48
19
27
II
14
47

22
26
21
20
10
28
29
291
31
32
30
17
18
15
16
27
271
14

HAND-HELD POWER TOOL

CROSS-REFERENCE TO A RELATED APPLICATION

The invention described and claimed hereinbelow is also described in German Patent Application DE 102004012433.7 filed on Mar. 13, 2004. This German Patent Application, whose subject matter is incorporated here by reference, provides the basis for a claim of priority of invention under 35 U.S.C. 119(a)-(d).

BACKGROUND OF THE INVENTION

The present invention is directed to a hand-held power tool, in particular a rotary hammer.

With a known hand-held power tool designed as a rotary/chisel hammer, the tool fitting is fixedly connected with a rotary or drive sleeve that is drivable in a rotatory manner by a driven wheel of a drive transmission situated on the rotary sleeve. The tool held in the tool fitting in an axially limited, displaceable manner is acted upon in the axial direction by an impact mechanism that impacts the shank end of the tool in a pulsed manner via a ram or a beatpiece. The hand-held power tool is selectively operable in the "impact drilling" mode or the "chiseling" mode. The tool is acted upon by the impact mechanism in both modes. In the "impact drilling" mode, in which an impact drill is inserted in the tool fitting, the tool fitting and, therefore, the tool are driven in a rotatory manner. In the "chiseling" mode, in which a chiseling tool is inserted in the tool fitting, the tool fitting is non-rotatably fixed to the mounting housing, and the chiseling tool only makes a hammering motion via the action of the impact mechanism. A duty-type switch is used to switch between modes, the switch including a manually operated rotary knob and an engaging fork capable of being displaced by the rotary knob. A coupling ring is installed on the engaging fork, the coupling ring fixedly coupling the rotary sleeve with the driven wheel of the drive transmission in a first displacement position and, in a second displacement position, fixedly joining the rotary sleeve with the machine housing. In an intermediate position, the coupling ring engages with neither the driven wheel nor the machine housing, so that the rotary sleeve and, therefore, the tool fitting, are free to rotate without being driven.

In the case of hand-held power tools with a rotating tool, operator errors, work piece faults or destruction of the tool can cause forces to act on the hand-held power tool that the operator is unable to control and, under certain circumstances, can result in injury to the operator.

In the case of a known hand-held power tool with a rotating tool (EP 0 771 619 B1), a system is installed with which uncontrolled jamming is detected and the resultant rotational motion of the machine housing is braked and limited. The system includes a sensor that detects the movement quantity that characterizes the special dimensions of the hand-held power tool as a whole, e.g., acceleration, rotational speed, or rotational travel of the machine housing, an operator that generates a control signal when a predefined threshold value of the movement quantity supplied by the sensor is reached or exceeded, and an actuator that interrupts the drive for the rotating tool based on the control signal from the operator. The actuator is designed as a separating clutch in the drive train of the tool and/or as a switch for turning off the drive motor and/or as a clutch for abruptly connecting the drive train with the machine housing.

SUMMARY OF THE INVENTION

The hand-held power tool according to the invention, has the advantage that, by replacing the method of switching modes from the use of a manual rotary knob to the use of an electronically controlled actuator, a switching-over between modes that is independent of the operator is carried out that rules out switching over during operation and thereby reduces maloperation and component wear, resulting in a longer service life of the machine overall. In the simplest case, the mode is preselected by the operator using a button located on the machine housing. In a more luxurious design, the modes are set automatically in that a sensor senses the type of tool inserted in the tool fitting and sends a corresponding characteristic signal to the electronic control unit, which sets the associated mode. In the latter case, an increased safety aspect results, since the risk of accidents is prevented, specifically accidents that are caused by the hand-held power tool being set in a mode that does not match the machining tool inserted in the tool fitting, e.g., the "impact drilling" mode with a chiseling tool inserted in the tool fitting.

Due to the measures listed in the further claims, advantageous further developments and improvements of the hand-held power tool described in Claim 1 are made possible.

According to an advantageous embodiment of the present invention, a manually operated, electric switch for turning the machine on and off is located on the machine housing, the electric switch being designed as a "deadman's switch" to provide an additional level of safety to the operator during drilling, i.e., in the "impact drilling" mode when the tool is rotating, it must be held manually in its closed position against the force of a reset spring. When the switch is released, the circuit is opened and the machine comes to a standstill. Since a "deadman's switch" of this type is not required in the "chiseling" mode with a tool fitting fixed to the machine housing, according to an advantageous embodiment of the present invention, an electromagnet controlled by the control device is assigned to the electric switch, the magnetic force of the electromagnet being greater than the spring force of the reset spring. The control unit is designed such that it provides an excitation current to the electromagnet in the mode with a non-rotating tool, the excitation current holding the electric switch in the closed position even when the operator is not actuating the switch.

According to an advantageous embodiment of the present invention, the electric switch is configured such that it can be manually lifted away from the energized electromagnet to be moved to its open position, so that the machine can also be turned off at any time during exclusively impact operation. Since the power supply to the electromagnet is also interrupted when the electric switch is opened, the electric switch must be closed before power can be resupplied to the electromagnet.

In a further embodiment of the present invention, the electronic signal for switching between modes can also be used to activate the booster function—which is known per se—in the hand-held power tool. A booster function of this type adjusts the electric drive motor after the switchover to the exclusively impact mode.

According to an advantageous embodiment of the present invention, a sensor connected to the control unit for detecting a tool jam in the mode with a rotating tool fitting is located on the machine housing, and the control unit is configured such that it de-energizes the electric motor when a sensor signal is received and triggers the actuator to switch to the mode with a tool fitting installed on the machine housing, or to allow the tool fitting to freewheel. Due to this design feature, a safety feature for an uncontrolled jam is easily integrated in the hand-held power tool that utilizes existing components and requires no additional hardware except for the sensor to detect the jam. By triggering the actuator accordingly, it is possible to fix the drive sleeve that starts the tool rotating to the machine housing or to allow it to rotate freely without being driven.

The present invention is described in greater detail below with reference to an exemplary embodiment shown in the drawing.

DESCRIPTION OF THE PREFERRED EMBODIMENT

Figures 1, 2:
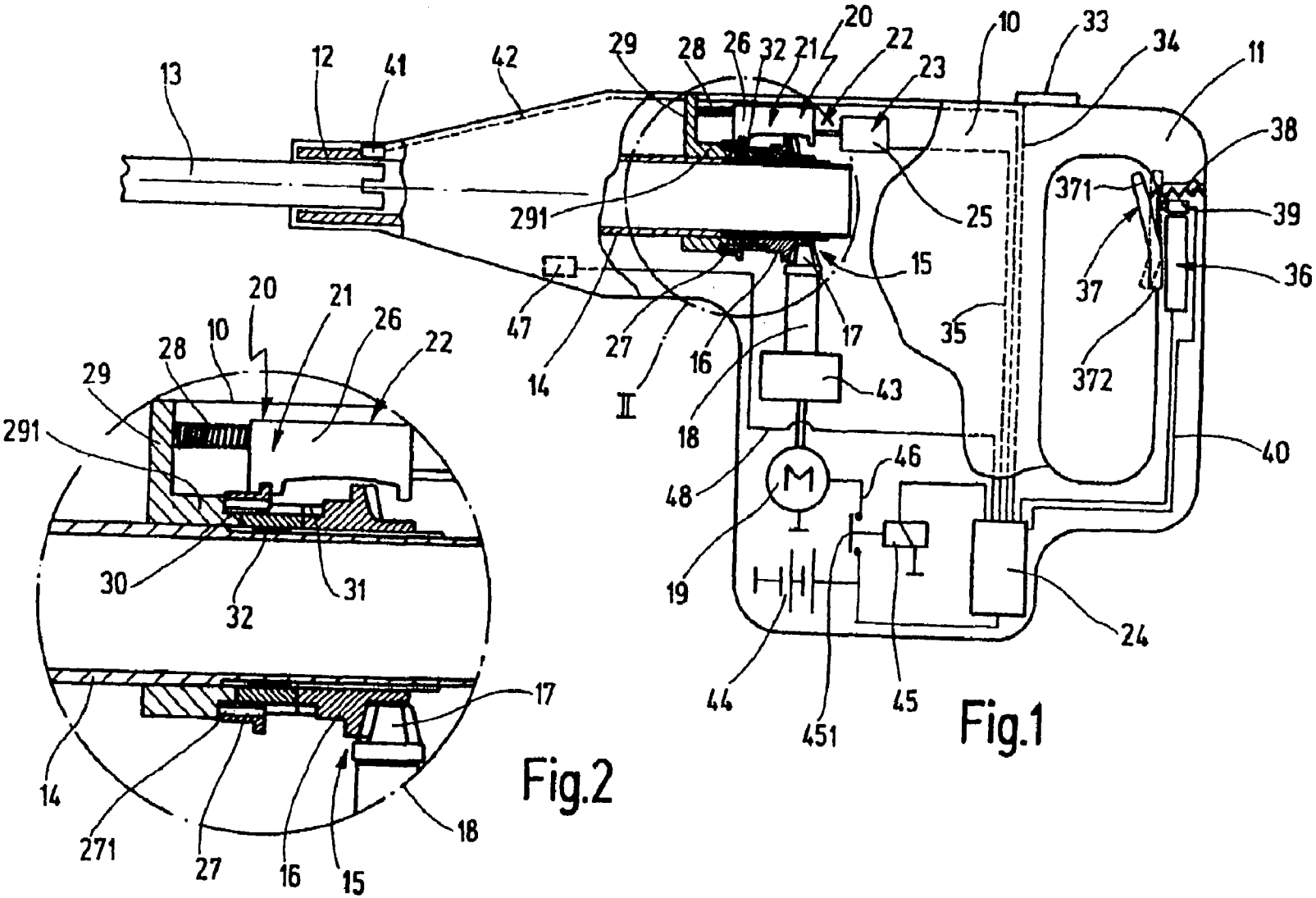
FIG. 1 Shows a schematized side view of a hand-held power tool, with some sections exposed, FIG. 2 Shows an enlarged illustration of section 11 in FIG. 1.

The hand-held power tool shown schematized in a side view in FIG. 1 is designed as a rotary hammer that is selectively operable in a "impact drilling" mode or a "chiseling" mode. The hand-held power tool includes a machine housing 10 with an integrally-moulded bow handle 11 for holding the machine. A tool fitting 12 is integrated in machine housing 10 on the end of machine housing 10 opposite bow handle 11, into which said tool fitting 12 a replaceable tool 13 is insertable such that it is non-rotatable and displaceable in an axially limited manner. In the impact drilling mode, tool 13 is an impact drill. In the hammering or chiseling mode, it is a chiseling tool. Although not shown, tool fitting 12 is fixedly coupled to a drive sleeve 14 that is rotatably supported in machine housing 10, drive sleeve 14 being drivable in a rotatory manner by an electric motor 19, shown here in a schematized view, via toothed gearing 15 configured here as bevel gearing. Toothed gearing 15 includes a driven wheel 16 that is rotatably mounted on drive sleeve 14 and a pinion 17 that meshes with driven wheel 16. Pinion 17 is non-rotatably situated on driven shaft 18, which is driven either directly or via an intermediate gearing 43 by electric motor 19. Although not shown, an impact mechanism is also driven by electric motor 19, which strikes the end face of tool 13 retained in tool fitting 12 via an impact piston guided in an axially displaceable manner in drive sleeve 14, and rams or beatpieces, with an intermediate air cushion. An example of the design of the impact mechanism is described in DE 28 20 128 A1.

A duty-type switch 20 is provided for setting the duty types or modes, duty-type switch 20 including an axially displaceable coupling element 21 and an actuating element 22 that induces the displacement. Coupling element 21 is designed such that, in a first displacement setting, it fixedly couples driven wheel 16 of toothed gearing 15 with drive sleeve 14 and, in a second displacement setting, non-rotatably fixes drive sleeve 14 to machine housing 10. To this end, actuating element 22 includes an electrical actuator 23 and an electronic control unit 24 that controls actuator 23. In the exemplary embodiment in FIG. 1, electrical actuator 23 is designed as an electromagnet 25. As an alternative, electrical actuator 23 can also be an electrical servomotor. Coupling element 21 actuated by actuator 23 includes an engaging fork 26 and an intermediate ring 27 with inner toothing 271 fastened to engaging fork 26 (FIG. 2). When electromagnet 25 is energized, engaging fork 26 is displaceable against the force of a reset spring 28. Reset spring 28 designed as a compression spring in this case bears against engaging fork 26 on one side and against a support 29 fixed to machine housing 10 on the other side. Holder 29 encloses drive sleeve 14 via an integrally-moulded retaining sleeve 291. On its end section facing driven wheel 16, retaining sleeve 291 includes an outer annular toothed section 30. On its end section facing holder 29, driven wheel 16 includes an outer gear rim 31, the tooth spacing of which matches the tooth spacing of toothed section 30 on retaining sleeve 291. Between retaining sleeve 291 and driven wheel 16, a toothed wheel 32 with outer toothing is non-rotatably situated on drive sleeve 14, the tooth spacing of which also matches the tooth spacing of toothed section 30 and gear rim 31. Toothed wheel 32, via its end face, abuts retaining sleeve 291 and driven wheel 16 and has an axial width that is slightly greater than the axial width of intermediate ring 27. Intermediate ring 27 engages via its inner toothing 271 in outer toothing of toothed wheel 32 and, depending on the displacement, can also engage with gear rim 31 on driven wheel 16 or with toothed section 30 of retaining sleeve 291. In the first-mentioned displacement position of intermediate ring 27 that it assumes via action of reset spring 28 when electromagnet 25 is not energized, driven wheel 16 is non-rotatably connected via intermediate ring 27 with toothed wheel 32, so that driven wheel 16 is non-rotatably connected with drive sleeve 14. In the second displacement position, in which intermediate ring 27 is moved against the force of reset spring 28 via displacement of engaging fork 26 when full current is supplied to electromagnet 25, toothed wheel 32 is fixedly connected with toothed section 30, so that drive sleeve 14—on which toothed wheel 32 is non-rotatably mounted—is held on holder 29 in a non-rotatable manner. In the first displacement position of intermediate ring 27, the hand-held power tool operates in the "impact drilling" mode, in which the rotary drive and the impact mechanism are both active, and in the second displacement position of intermediate ring 27, the hand-held power tool operates in the "chiseling" mode, in which tool 13 is driven only by the impact mechanism.

Duty-type switch 20 also includes a button 33 located on machine housing 10, with which the operator can manually preselect the desired mode. Button 33 is connected to control unit 24 via a connecting line 34 indicated in FIG. 1 with dashed lines. The line that connects control unit 24 with electromagnet 25 is labelled 35.

An electric switch 36 is used to turn electric motor 19 of hand-held power tool on and off, the electric switch being supplied with current in this case, as is control unit 24, by a rechargeable battery 44. Electric switch 36 can be actuated manually using a flip switch 37 and, in fact, in a manner such that when flip switch 37 is pressed, switch 36 is closed and, when flip switch 37 is released, switch 36 opens. Flip switch 37 is reset using a compression spring 38. Electric switch 36 is designed as a "deadman's switch" as a safety feature for the operator so that the drive of hand-held power tool can be switched off by releasing flip switch 37.

When electric switch 36 is closed, power is also supplied to control unit 24. The preselect signal supplied by button 33 for the desired mode of the hand-held power tool is processed in control unit 24 and, depending on the specification, either energizes or de-energizes electromagnet 25. If the "chiseling" mode was preselected, electromagnet 25 is energized, and it moves engaging fork 26 with intermediate ring 27 against the force of reset spring 28 into the displacement position shown in FIGS. 1 and 2, in which intermediate ring 27 non-rotatably fixes drive sleeve 14 to retaining sleeve 291. When the electric motor is switched on, it only drives the impact mechanism, while driven wheel 16—which was also set into rotation by electric motor 19—rotates freely on drive sleeve 14. If the "impact drilling" mode was preselected, electromagnet 25 is de-energized by control unit 24, and reset spring 28 pushes engaging fork 26 with intermediate ring 27 in FIGS. 1 and 2 to the right until inner toothing 271 of intermediate ring 27 engages in gear rim 31 on driven wheel 16. Driven wheel 16 is now non-rotatably connected via intermediate ring 27 and gear rim 32 with drive sleeve 14, and tool 13 is now also driven rotatively via drive sleeve 14 and tool fitting 12.

Since the "deadman's" function of electric switch 36 is not required—nor is it desired—in the "chiseling" mode, for safety reasons, an electromagnet 39 is assigned to electric switch 36, electromagnet 39 being connected to control unit 24 by a connecting line 40. Electromagnet 39 is designed such that, when energized, it produces a magnetic force that is greater than the reset force of compression spring 38. If the "chiseling" mode was preselected using button 33, control unit 24 initiates the energization of electromagnet 39, which holds electric switch 36 in the closed position against the force of compression spring 38, even when flip switch 37 of electric switch 36 is released. To also allow the impact mechanism to be brought to a standstill at any time in the "chiseling" mode, flip switch 37 is designed in the manner of a rectangular lever with a long lever arm 371 and a short lever arm 372. If the operator, using a finger, presses long lever arm 71 of flip switch 37, electric switch 36 is moved into its closed position, in which it is held in the "chiseling" mode by energized electromagnet 39. If the operator presses short lever arm 372, electric switch 36 is returned to its open position against the magnetic force of electromagnet 39, and the current supply to electric motor 19 is interrupted.

In a further embodiment of the hand-held power tool, the electronic switchover between modes is not carried out via preselection by the operator, but rather automatically, depending on the type of tool 13 inserted in tool fitting 12. To this end, a sensor 41 is installed in tool fitting 12, which detects the presence of a tool 13 in tool fitting 12 and the type of tool 13, i.e., it determines whether it is an impact drill or a chiseling tool. Sensor 41 is connected to electronic control unit 24 via connecting line 42. Button 33 with connecting line 34 is not provided. If electric switch 36 of the hand-held power tool is now closed, sensor 41 outputs a tool-classification signal to control unit 24. If the classification signal is characteristic for a chiseling tool, electronic control unit 24 initiates energization of electromagnet 25, and the "chiseling" mode is set in the drive setting, i.e., electric motor 19 drives only the impact mechanism. If the classification signal supplied by sensor 41 to control unit 24 is characteristic for an impact drilling tool, control unit 24 does not initiate energization of electromagnet 25. Reset spring 28 serves to set the "impact drilling" mode in the drive system. Electromotor 19 drives the impact mechanism and drive sleeve 14.

As shown schematically in FIG. 1, the power-supply connection of electromotor 19 to rechargeable battery 44 takes place via switch contact 451 of an electromagnetic relay 45 situated in the connecting line 46 of electromotor 19 and rechargeable battery 44. Relay 45 is triggered by control unit 24. Relay 45 is energized and relay contact 451 remains closed for as long as electric switch 36 remains closed. Duty-type switch 20 is also used to equip the hand-held power tool with a safety feature in case of an uncontrolled jam. A jam occurs when, due to an operator error or a work piece fault, the rotating tool is braked extremely or stops altogether and, as a result, intense rotation of the housing of the hand-held power tool is triggered, which can result in injury to the operator. To this end, a sensor 47 is located in machine housing 10 that senses when a tool is jammed and outputs an appropriate output signal to control unit 24 via connecting line 48. To this end, the sensor detects a movement quantity of machine housing 10, e.g., its acceleration or speed or a path of rotation. This movement quantity is compared with a predefined threshold in control unit 24. If the sensor signal reaches or exceeds this threshold, control unit 24 de-energizes relay 45, so that relay contact 451 opens and electric motor 19 is turned off. Control unit 24 also triggers energization of electromagnet 25. Energized electromagnet 25 displaces engaging fork 26 against the force of reset spring 28 until intermediate ring 27—and its inner toothing 271 connected with it—disengage from gear rim 31 on driven wheel 16, so that driven wheel 16 rotates freely on drive sleeve 14 and the drive train that rotates tool 13 is interrupted. By way of a corresponding level of energization of electromagnet 25, intermediate ring 27 is either displaced until its inner toothing 271 engages with toothed section 30 on retaining sleeve 291 and therefore non-rotatably fixes drive sleeve 14 via toothed wheel 32 to machine housing 10, or it is displaced only so far that inner toothing 271 meshes only with toothed wheel 32. In the latter case, drive sleeve 14 and, therefore, tool fitting 12, remain free to rotate without being driven.

What is claimed is:

1. A hand held power tool, comprising: a machine housing (10), a tool fitting (12) integrated therein, the tool fitting (12) being drivable in a rotatory manner by an electric motor (19) in a first mode of operation and being non-rotatably fixable to the machine housing (10) in a second mode of operation, a duty-type switch (20) and a coupling element (21) displaceable to activate the modes, and an actuating element (22) that includes a displacement of said coupling element, wherein the actuating element includes an electrical actuator (23) and an electronic control unit (24) that controls the actuator (23), wherein a manually operated, electric switch (36) for turning the machine on and off is located on the maching housing (10), electric switch (36) being designed such that it must be manually held against the force of a reset spring (38) in the mode with tool fitting (12) being driven in a rotating manner, wherein an electromagnet (39) controlled by the control device (24) is assigned to the electric switch (36), the magnetic force of which is greater than the spring force of the reset spring (38), and the control unit (24) is configured such that it supplies an excitation current for the electromagnet (39) assigned to the electric switch (36) with a tool fitting (12) installed on the machine housing (10).

2. The hand-held power tool as recited in claim 1, wherein the electric switch (36) is configured such that it is manually liftable away from the energized electromagnet (39) to be moved to its open position.

3. The hand-held power tool as recited in claim 2, wherein the electric switch (36) includes a flip switch (37) designed in the manner of a rectangular lever with a long and a short lever arm (371, 372), and is configured such that the switch (36) is movable into its closed position by a compressive force on the long lever arm (371), and such that it can be moved to its open position by a compressive force on the short lever arm (372) against the magnetic force of the energized electromagnet (39).

4. The hand-held power tool as recited in any one of the claims 2 or 3, wherein the duty-type switch (20) includes a sensor (41) connected to the control unit (24) for classifying a tool (13) inserted in the tool fitting (12), and wherein the control unit (24) triggers the actuator (23) for adjusting the tool (13) installed in the tool fitting (12) as a function of the classification signal from the sensor (41).

5. Hand-held power tools as recited in claim 1, wherein the actuator (23) is an electrical servomotor.

6. The hand-held power tool as recited in claim 1, wherein the actuator (23) is an electromagnet (25).

7. The hand-held power tool as recited in claim 1, wherein the coupling element (21) includes an engaging fork (26) actuated by the actuator (23), to which the intermediate ring (27) is fastened and on which the reset spring (28) acts.

8. The hand-held power tool as recited in claim 6, wherein the actuating element (22) includes a reset spring (28) with a spring force directed against the magnetic force of the electromagnet (25).

9. A hand held power tool, comprising: a machine housing (10), a tool fitting (12) integrated therein, the tool fitting (12) being drivable in a rotatory manner by an electric motor (19) in a first mode of operation and being non-rotatably fixable to the machine housing (10) in a second mode of operation, a duty-type switch (20) and a coupling element (21) displaceable to activate the modes, and an actuating element (22) that induces a displacement of said coupling element wherein the actuating element includes an electrical actuator (23) and an electronic control unit (24) that controls the actuator (23), wherein the tool fitting (12) is fixedly coupled to a drive sleeve (14) rotatably supported in the machine housing (10), a driven wheel (16) of toothed gearing (15)—preferably bevel gearing—coupled to an electric motor (19) is rotatably mounted on the drive sleeve (14), a gear rim (32) axially directly adjacent to the driven wheel (16) is rotatably mounted on the drive sleeve (14), the driven wheel (16) includes a gear rim (31), the tooth spacing of which matches that of the gear rim (32), and a toothed section (30) which has the same tooth spacing that encompasses the drive sleeve (14) and faces the gear rim (32) is located on the housing (10), the coupling element (21) includes an axially displaceable intermediate ring (27) with internal toothing (271) configured such that it is selectively engageable with the gear rim (32) and the toothed section (30) on the machine housing (10) or with the gear rim (32) or with the gear rim (32) and the gear rim (31) on the driven wheel (16), wherein the duty-type switch (20) includes a button (33) located on the machine housing (10) for preselection of the modes, the button (33) being connected to the control unit (24), wherein a manually operated, electric switch (36) for turning the machine on and off is located on the machine housing (10), electric switch (36) being designed such that it must be manually held against the force of a reset spring (38) in the mode with tool filling (12) being driven in a rotating manner, and wherein an electromagnet (39) controlled by the control device (24) is assigned to the electric switch (36), the magnetic force of which is greater than the spring force of the reset spring (38), and the control unit (24) is configured such that it supplies an excitation current for the electromagnet (39) assigned to the electric switch (36) during the mode with a tool fitting (12) installed on the machine housing (10), and wherein, when the electromagnet (25) is triggered, the intermediate ring (27) is moved to a displacement setting in which its internal toothing (271) is engaged with the gear rim (32) on the drive sleeve (14) and with the toothed section (30) on the machine housing (10).

10. The hand-held power tool as recited in claim 9, wherein the electromagnet (25) is triggered with reduced excitation current that ensures that the displacement of the intermediate ring (27) is sufficient to disengage its internal toothing (271) from the gear rim (31) on the driven wheel (16).

11. The hand-held power tool as recited in claim 9, wherein, in the mode with a rotatably driven tool fitting (12), the electromagnet (25) is de-energized and the intermediate ring (27) is moved by the reset spring (28) acting on the engaging fork (26), so that internal toothing (271) is engaged with the gear rim (31) on the driven wheel (16).

12. The hand-held power tool as recited in claim 9, wherein the sensor detects a movement quantity of the machine housing.

13. The hand-held power tool as recited in claim 12, wherein the movement quantity of the machine housing is selected from the group consisting of acceleration, speed, and path of rotation.

* * * * *